US007926668B2

(12) United States Patent
Barkdoll

(10) Patent No.: US 7,926,668 B2
(45) Date of Patent: Apr. 19, 2011

(54) TRACKLESS RETAIL PUSHER SYSTEM

(75) Inventor: Patrick J. Barkdoll, Pecatonica, IL (US)

(73) Assignee: Southern Imperial, Inc., Rockford, IL (US)

( * ) Notice: Subject to any disclaimer, the term of this patent is extended or adjusted under 35 U.S.C. 154(b) by 1142 days.

(21) Appl. No.: 11/436,366

(22) Filed: May 18, 2006

(65) Prior Publication Data

US 2007/0267364 A1 Nov. 22, 2007

(51) Int. Cl.
*A47F 7/00* (2006.01)

(52) U.S. Cl. ..... 211/59.3

(58) Field of Classification Search ..... 211/59.2, 211/59.3, 184; 312/61, 71
See application file for complete search history.

(56) References Cited

U.S. PATENT DOCUMENTS

| | | | | | |
|---|---|---|---|---|---|
| 3,848,745 | A | * | 11/1974 | Smith | 211/59.3 |
| 4,712,694 | A | * | 12/1987 | Breslow | 211/184 |
| 4,830,201 | A | * | 5/1989 | Breslow | 211/184 |
| 4,836,390 | A | * | 6/1989 | Polvere | 211/59.3 |
| 4,901,869 | A | * | 2/1990 | Hawkinson et al. | 211/59.3 |
| 5,240,126 | A | * | 8/1993 | Foster et al. | 211/59.3 |
| 5,265,738 | A | | 11/1993 | Yablans et al. | |
| 5,685,664 | A | * | 11/1997 | Parham et al. | 403/393 |
| 5,839,588 | A | * | 11/1998 | Hawkinson | 211/59.3 |
| 5,971,173 | A | | 10/1999 | Valiulis et al. | |
| 6,041,720 | A | * | 3/2000 | Hardy | 108/60 |
| 6,082,558 | A | * | 7/2000 | Battaglia | 211/59.3 |
| 6,105,791 | A | * | 8/2000 | Chalson et al. | 211/59.3 |
| 6,109,458 | A | * | 8/2000 | Walsh et al. | 211/59.3 |
| 6,129,218 | A | * | 10/2000 | Henry et al. | 211/59.3 |
| 6,286,690 | B1 | | 9/2001 | Thalenfeld | |
| 6,409,028 | B2 | * | 6/2002 | Nickerson | 211/59.3 |
| 6,769,552 | B1 | | 8/2004 | Thalenfeld | |
| 6,820,754 | B2 | * | 11/2004 | Ondrasik | 211/59.3 |
| 6,824,009 | B2 | | 11/2004 | Hardy | |
| 6,886,699 | B2 | * | 5/2005 | Johnson et al. | 211/59.3 |
| 6,889,854 | B2 | | 5/2005 | Burke | |

(Continued)

FOREIGN PATENT DOCUMENTS

DE 20 2005 010 088 U1 10/2005

(Continued)

OTHER PUBLICATIONS

POS Tuning UDO Voβhenrich, The POS Product Pusher; http://www.postuning.de/69.0.html?&L=25/31/2006 11:51:42 AM, website, date last visited May 31, 2006, 1 page.

(Continued)

*Primary Examiner* — Jennifer E. Novosad
(74) *Attorney, Agent, or Firm* — Reinhart Boerner Van Deuren P.C.

(57) ABSTRACT

A pusher system for biasing retail merchandise forward is provided. The pusher system includes a front wall structure, a pair of walls, a pusher, and a spring. The pair of walls are operably coupled to the front wall structure. The pair of walls are in opposing spaced relation to each other. The pair of walls are also transverse to and extend rearwardly from the front wall structure to define a receptacle for the retail merchandise. The pusher is interposed between the pair of walls. The spring acts upon the pusher such that the pusher is movable toward the front wall structure between the pair of walls under the action of the spring. The pusher is movable laterally between and guided by the walls so that the pusher is free of a central track.

10 Claims, 8 Drawing Sheets

U.S. PATENT DOCUMENTS

| | | | | |
|---|---|---|---|---|
| 6,923,330 | B1 | 8/2005 | Nagel | |
| 6,964,235 | B2 | 11/2005 | Hardy | |
| 7,293,663 | B2 * | 11/2007 | Lavery, Jr. | 211/59.3 |
| 7,395,938 | B2 * | 7/2008 | Merit et al. | 211/59.4 |
| 2002/0108916 | A1 * | 8/2002 | Nickerson | 211/59.3 |
| 2003/0057167 | A1 * | 3/2003 | Johnson et al. | 211/59.3 |
| 2005/0056602 | A1 | 3/2005 | Hardy | |
| 2005/0189309 | A1 | 9/2005 | Hardy | |
| 2006/0049122 | A1 * | 3/2006 | Mueller et al. | 211/59.3 |
| 2006/0226095 | A1 | 10/2006 | Hardy | |
| 2007/0251900 | A1 * | 11/2007 | Hardy | 211/59.3 |
| 2007/0267367 | A1 * | 11/2007 | Mueller et al. | 211/59.3 |
| 2009/0101606 | A1 * | 4/2009 | Olson | 211/59.3 |

FOREIGN PATENT DOCUMENTS

| | | | |
|---|---|---|---|
| EP | 1 256 296 | A2 | 11/2002 |
| EP | 1 541 064 | A1 | 6/2005 |
| EP | 1 541 064 | B1 | 2/2006 |
| GB | 2 360 514 | A | 9/2001 |
| WO | WO 2004/083051 | A2 | 9/2004 |

OTHER PUBLICATIONS

POS Tuning UDO Voβhenrich, The POS Systemtray; http://www.postuning.de/69.0.html?&L=25/31/2006 11:55:00 AM, website, date last visited May 31, 2006, 1 page.

* cited by examiner

TRACKLESS RETAIL PUSHER SYSTEM

FIELD OF THE INVENTION

This invention generally relates to pusher systems and, in particular, to a pusher system employed to front face retail merchandise on a retail shelf.

BACKGROUND OF THE INVENTION

To ensure that retail merchandise stocked upon a shelf is suitably presented to a potential customer, the merchandise is typically "faced." The process of facing often involves sliding the merchandise, which is typically situated upon the shelf in rows, toward a front edge of the shelf. When the merchandise is faced in this manner, the potential customer is presented with a neat, uniform, and aesthetically-pleasing display. In addition, the merchandise is best situated for viewing by the potential customer strolling down an aisle in the retail establishment and, as a result, leads to increased and/or optimized sales of the merchandise.

As business owners well know, facing is particularly important when the shelf carrying the merchandise is above or below a normal eye level of the potential customer. In these circumstances, the merchandise on the shelf is simply less noticeable and/or visible to the potential customer. If the merchandise is not properly faced and moved forward to the front of the shelf, the potential customer may not realize that the merchandise is available for purchase and, consequently, a potential sale of the merchandise is quickly lost. Therefore, the need to have the merchandise at or near the front edge of those less viewable shelves is desirable.

In the past and even today, employees were and still are burdened with the task of manually facing the merchandise arranged on the shelves. This is a time-consuming chore for the employees and one that must be performed frequently. In an attempt to relieve employees from having to continually face products, a number of different systems have been developed in recent years. These systems are designed to automatically move any remaining merchandise forward toward the front edge of the shelf as the potential customers remove items.

One of the automatic facing systems is known as a gravity feed system. The gravity feed system includes a planar surface tilted downwardly toward the front edge of the shelf. When the merchandise is placed on that downwardly canted surface, the merchandise is biased toward the front edge of the shelf due to the pull of gravity. Each time the foremost item of merchandise is removed from the system by a potential customer, gravity causes the remaining items to slide forward. While this system is suitable to move the merchandise closer to the potential customer, a considerable amount of valuable retail area or real estate is consumed by the tilted surface. In addition, due to gravity pulling downwardly on the entire row of merchandise, reinserting a single item is often difficult if the potential customer changes their mind after having removed that item from the gravity feed system.

As a supplement and/or an alternative to the gravity feed system, another of the automatic facing systems known as a pusher system is frequently employed. The pusher system relies on a spring to bias a paddle or pusher toward the front edge of the shelf. When a row of the merchandise is placed in front of the pusher, the spring drives the row ahead to the front edge of the shelf. In order to center the pusher behind the merchandise and to guide the pusher forward, a typical pusher system secures the pusher within a central track as shown in, for example, U.S. Pat. No. 6,889,854 to Burke. The central track is prone to be clogged with debris and then sticking or malfunctioning. As a result, the merchandise is not faced as expected.

In addition to the above, without the track the merchandise may be able to bend or bow any divider walls included in the pusher system outwardly. As a result, the merchandise is not held in a tight, linear arrangement on the shelf. Also, without the track the pusher may slip off the back of the rear item and, therefore, the merchandise is not faced as desired.

There exists, therefore, a need in the art for a pusher system that addresses one or more of the above-noted disadvantages of known facing systems. The invention provides such a system.

BRIEF SUMMARY OF THE INVENTION

The invention provides a pusher system that automatically faces retail merchandise yet operates without tracks. Instead of using tracks, the pusher system employs a pusher having a curved forward face. The curved forward face defines a radial profile for the pusher and includes an upright channel. This configuration keeps retail merchandise centered when being moved forward toward a front wall structure or fence. The shape of the pusher also avoids the roll over effect caused by a wound spiral spring located inside the pusher.

In addition to the previously mentioned benefits, the pusher does not impede the insertion of the retail merchandise if the pusher has been somewhat rotated or tipped forward after the last item of merchandise has been removed. The curved forward face ensures that a single contact point between the pusher and the retail merchandise is established. As such, the retail merchandise is easily reinserted back into the pusher system after having been removed. The curved forward face also offers better contact with those items of retail merchandise with rounded and elliptical shapes (e.g., bottles) as opposed to flat, planar sides.

Further, the walls or dividers used in the pusher system have a wide horizontal base portion. As such, the walls are provided with increased rigidity to prevent the walls from bowing or bending outwardly away from the retail merchandise. Moreover, the sufficiently rigid walls help maintain an approximately ninety degree angle between the walls and the front wall structure. By providing this rigidity and structural integrity, the need for a rear wall or back rail often found in conventional pusher systems is eliminated.

The pusher system can also takes up less space on a retail shelf. In other words, the pusher system is more compact and efficient compared to conventional pusher systems. As a result, more product can be displayed on a single shelf or stack of shelves using the disclosed pusher system. The ability to display more items of retail merchandise translates to increased sales and profit.

In one aspect, the invention provides a pusher system for biasing retail merchandise forward. The pusher system comprises a front wall structure, a pair of walls, a pusher, and a spring. The walls are operably coupled to the front wall structure. The walls are in opposing spaced relation to each other and transverse to and extending rearwardly from the front wall structure to define a receptacle for the retail merchandise. The pusher is interposed between the pair of walls. The spring acts upon the pusher such that the pusher is movable toward the front wall structure between the pair of walls under the action of the spring. The pusher is movable laterally between and guided by the walls whereby the pusher may be free of a central track.

In another aspect, the invention provides a pusher system for pushing retail merchandise. The pusher comprises a pusher housing, a spiral spring, and an alignment structure. The pusher housing defines a spring chamber and has a forward face. The spiral spring is coiled up and mounted in the spring chamber. The spiral spring having an end portion extendable out of the pusher housing beyond the forward face. The alignment structure is formed into the front face of the pusher housing The alignment structure has at least one channel configured for partially receiving the retail merchandise and for aligning the pusher housing relative to the retail merchandise.

In yet another aspect, the invention provides a pusher system for facing retail merchandise. The pusher system comprises a front wall structure, a pair of walls, and a pusher. The walls are movably interlocked with the front wall structure. The walls are transverse to and extend rearwardly from the front wall structure and are in adjustable opposing spaced relation with each other. The pusher is interposed between the pair of walls and disposed rearward of the front wall structure. The pusher includes a pusher housing, a mounting clip, and a spiral spring. The spiral spring is biased against the pusher housing and secured to the mounting clip. The mounting clip is interlocked with the front wall structure. The spiral spring unwinds and biases the pusher toward the front wall structure when the pusher is drawn rearwardly away from the front wall structure. As such, the retail merchandise is faced.

In another aspect, the invention provides a pusher system for facing retail merchandise. The pusher system comprises a front wall structure, a pair of walls, and a plurality of pushers. The walls are movably interlocked with the front wall structure. The walls are transverse to and extend rearwardly from the front wall structure and are in adjustable opposing spaced relation to each other. The plurality of pushers are interposed between the pair of walls and disposed rearward of the front wall structure. The pushers are coupled to the front wall structure at least in part through a spring. The spring draws the pusher toward the front wall structure when the pusher is drawn rearwardly away from the front wall structure to face the retail merchandise.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
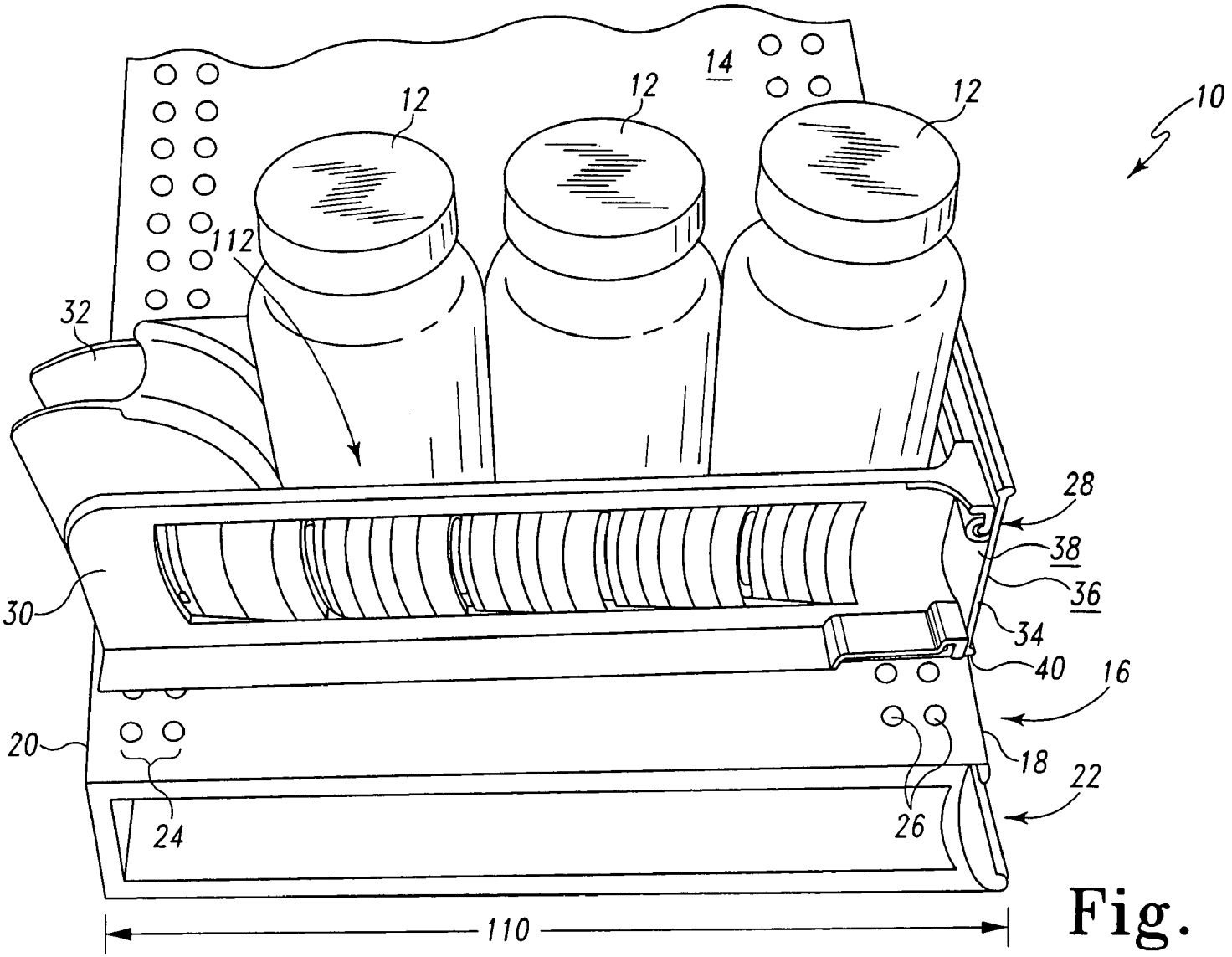
FIG. 1 is a side perspective-view of an exemplary embodiment of a pusher system, constructed in accordance with the teachings of the present invention, seated upon a shelf and holding several items of retail merchandise.

Referring to FIG. 1, a pusher system 10 for biasing retail merchandise 12 forward is illustrated. In general, the pusher system 10 is seated upon a top surface 14 of a retail shelf 16. The pusher system 10 extends between front and rear edges 18, 20 of the shelf 16. As well known in the art, the shelf 16 often includes a "c-shaped" channel 22 running along the front edge 18 as well as rows 24 of apertures 26 formed through the top surface 14 and extending generally parallel to the front and rear edges 18, 20. The c-shaped channel 22, apertures 26, and other features permit price tags, hooks, labels and other items to be displayed along side or with the retail merchandise 12.

The pusher system 10 comprises one or more front wall structure structures 28, two or more divider walls 30, and one or more pushers 32. For the sake of simplicity, the description will be had to a relatively simple embodiment having two divider walls, one front fence and a single pusher. However, it will be understood that product channels of the same or different widths can be created by utilizing three or more dividers with the front wall structure 28 and with one or more pushers installed into each product channel and connected to the front wall structure to self face product.

Figure 2:
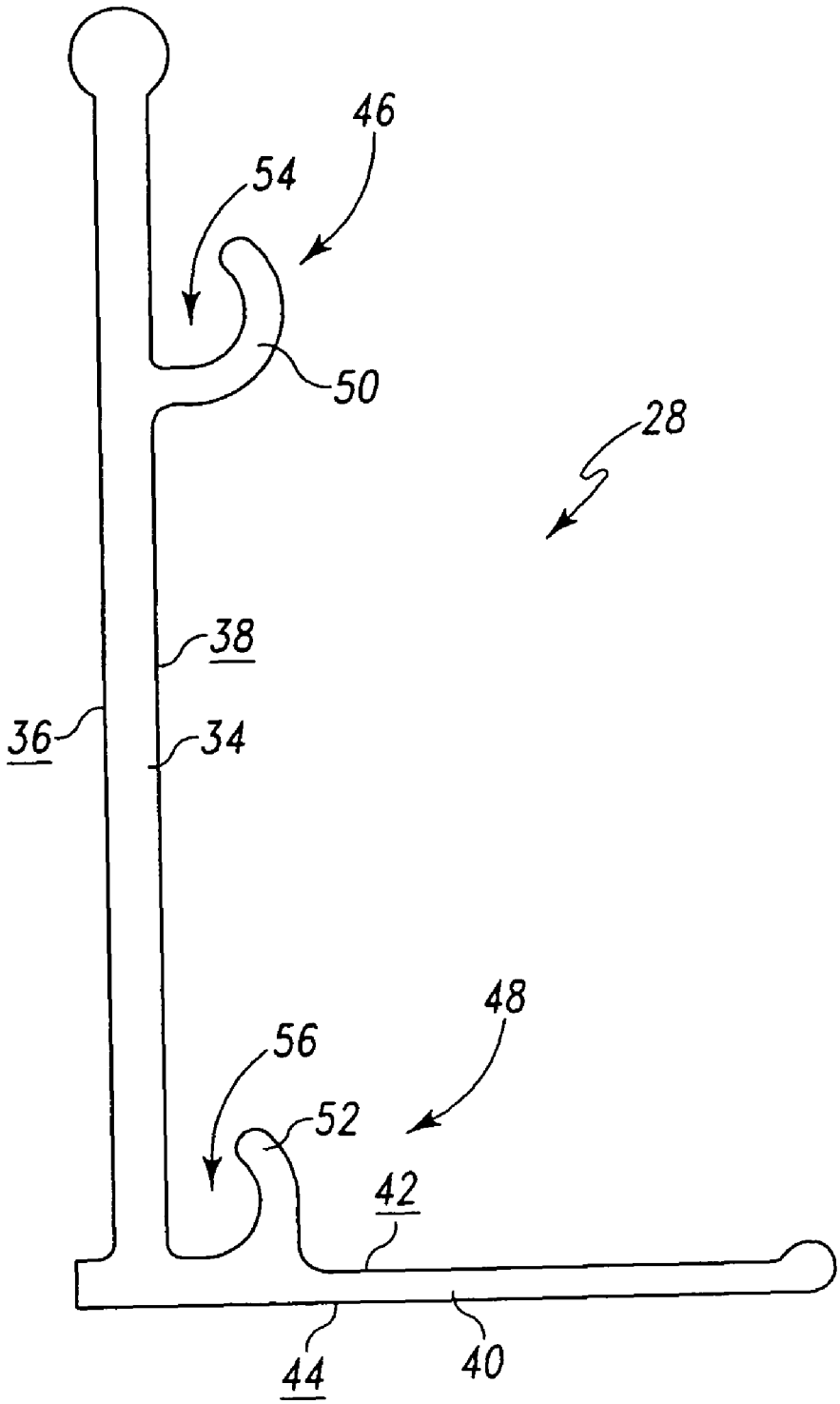
FIG. 2 is an elevation view of a front fence and rail that provide a front wall structure for the pusher system of FIG. 1.

As shown in detail in FIG. 2, the front wall structure 28 includes an upright or generally vertical front wall portion 34 integrally connected to a generally horizontal base portion 40. The front wall portion extends between a front face 36 and a rear face 38. The front face 36 is directed away from the retail merchandise 12 (FIG. 1) while the rear face 38 is directed toward, and engaged with, the retail merchandise.

The horizontal base portion 40 extends between an upper face 42 directed upwardly toward the retail merchandise 12 and a lower face 44 directed toward, and generally engaged with, the shelf 12. In the illustrated embodiment, the vertical front wall and horizontal base portions 34, 40 are integrally formed with and transverse to each other. In addition, the horizontal portion 40 projects slightly forward from the front face 36 and substantially rearwardly away from the rear face 40.

Figure 3:
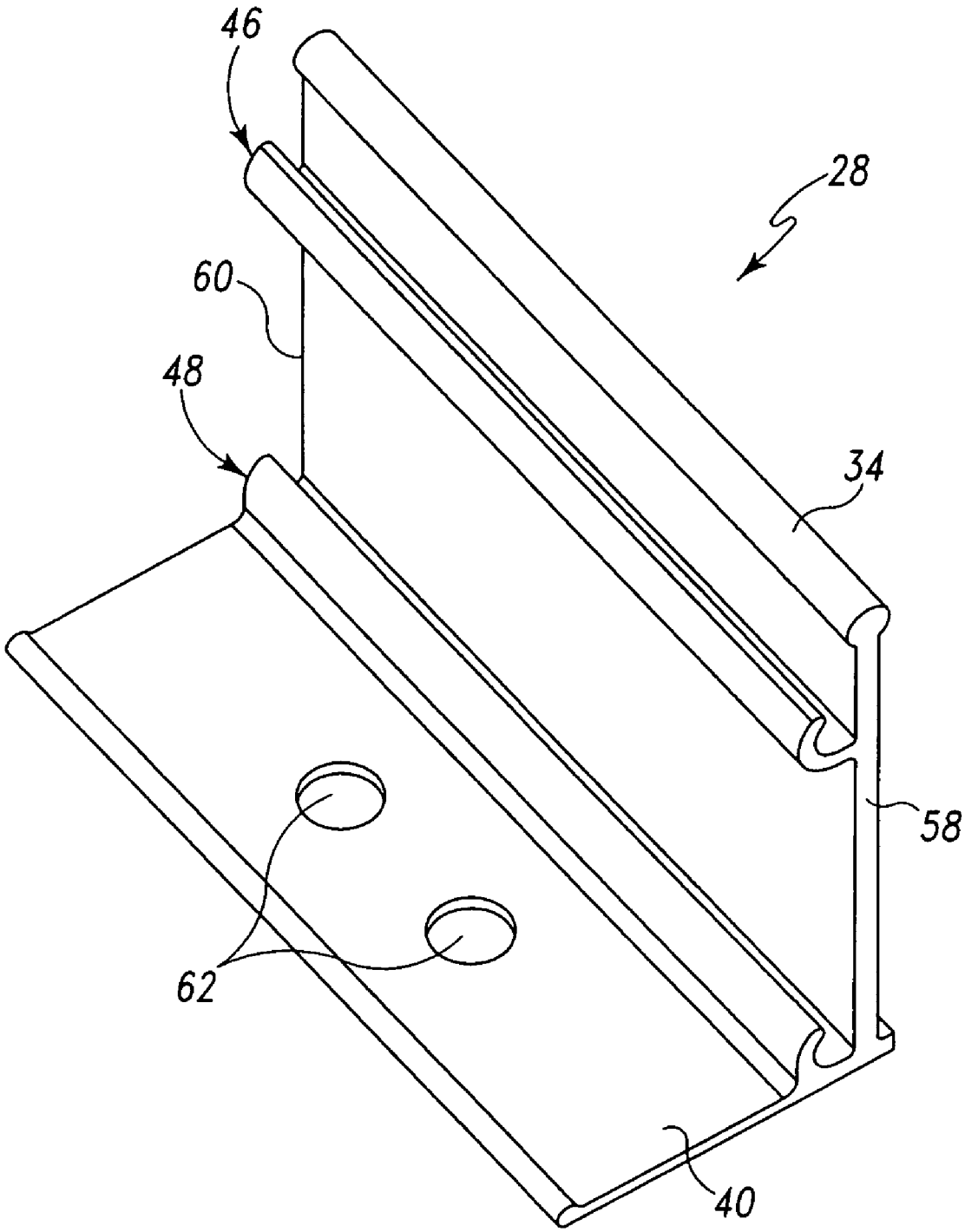
FIG. 3 is a top and back perspective view of the front wall structure of FIG. 2.

Still referring to FIG. 2, the rear face 38 of the front wall structure 28 includes an upper retaining rail 46 vertically disposed above a lower retaining rail 48. The retaining rails 48, 50 are integrally formed with the vertical and horizontal portions 34, 40 and extend co-parallel with each other. In the illustrated embodiment, each of the retaining rails 48, 50 form an elongated mounting clip 50, 52 that forms an upwardly-directed channel 54, 56. As shown in FIG. 3, the mounting clips 50, 52 and the channels 54, 56 generally extend along the rear surface 38 between opposing sides 58, 60 of the front wall structure 28.

In the illustrated embodiment shown in FIG. 3, the horizontal base portion 40 of the front wall structure 28 includes apertures 62. These apertures 62 through the base portion 40 are typically aligned with the apertures 26 passing through the top surface 14 of the shelf 16 (FIG. 1). Once aligned, buttons, pegs, and similar devices are inserted through the apertures 62, 26 to securely hold the pusher system 10 in place relative to the shelf 16.

Despite being illustrated as such, the vertical front wall portion 34 need not be a completely solid member. For example, in one embodiment, the vertical portion 34 is a fence, a slotted member, or another structure known to be used for retaining merchandise. By placing slots or apertures in the front portion, the merchandise 12 is more easily viewed. In one embodiment, all or a portion of the front wall structure 28 is formed from a transparent material to permit viewing of the merchandise 12. The front wall portion 34 (and/or base portion 40) also can form the front stop for the product channel formed between divider walls 30. One or more portions of the front wall structure 28 thus serve as a front stop to prevent retail merchandise product from falling off the front of the shelf.

Figure 4:
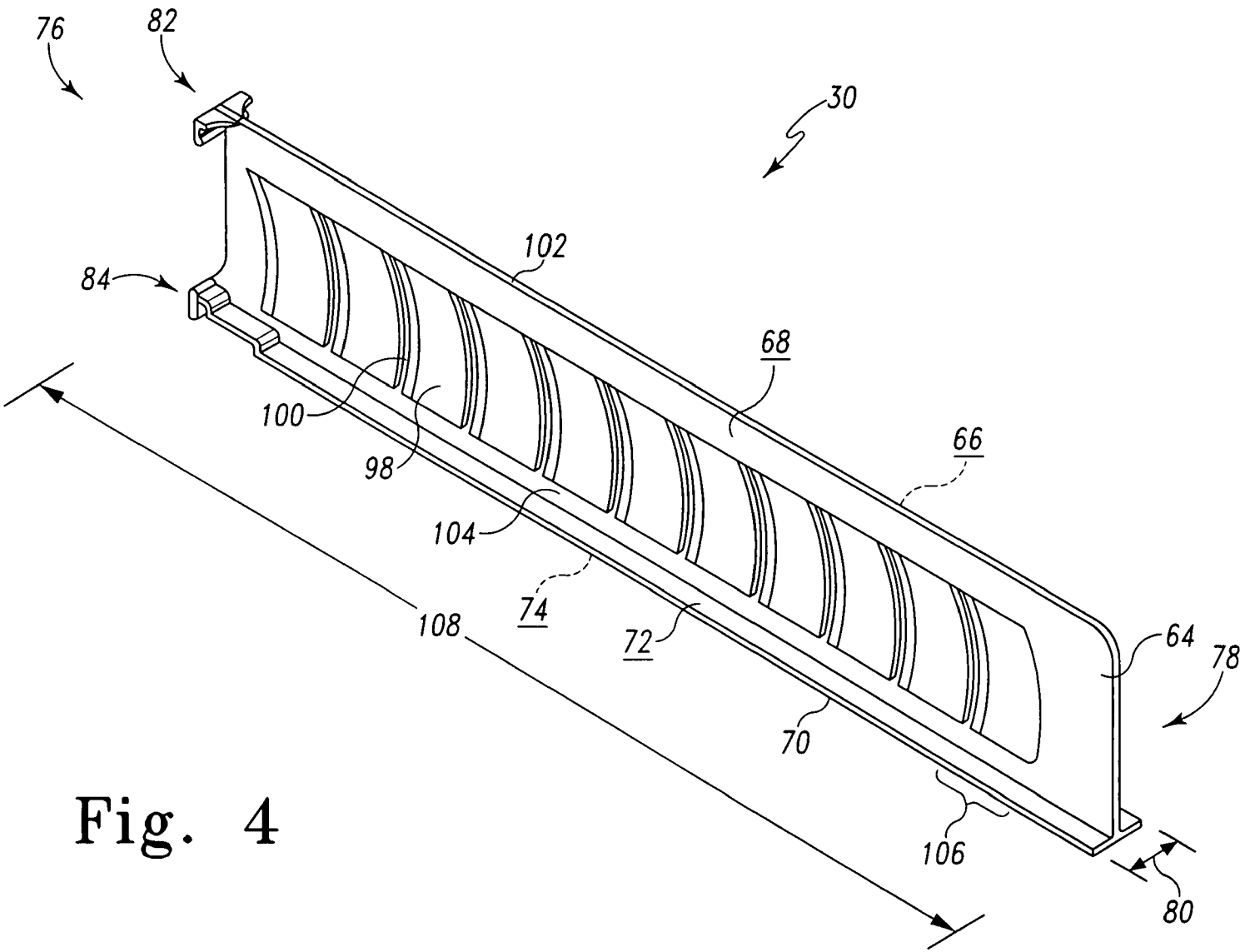
FIG. 4 is top and back perspective view of one of a pair of divider walls from the pusher system of FIG. 1.

Referring now to FIG. 4, one of divider walls 30 from FIG. 1 is illustrated. The divider wall 30 defines an upright or generally vertical portion 64 that extends upward from a generally horizontal base portion 70. The vertical portion extends between an outer face 66 directed outwardly away from the retail merchandise 12 (see FIG. 1) and inner face 68 directed toward, and possibly engaging, the retail merchandise (inner and outer are used to refer to the product channel in question; it is noted that for adjacent product channels, the outer face would be the inner face). The horizontal base portion 70 extends between an upper face 72 directed upwardly toward the retail merchandise 12 and a lower face 74 directed toward, and generally engaged with and resting upon, the shelf 16. In the illustrated embodiment, the vertical and horizontal portions 64, 70 are integrally formed with and transverse to each other.

As best shown in FIG. 4, divider walls 30 resemble an inverted "T-beam" in the illustrated embodiment. Due to this configuration, each of the walls 30 processes substantial rigidity. This rigidity and structural integrity inhibits the wall 30 from bowing or bending outwardly away from the merchandise 12 as the wall progresses from a front end 76 to a rear end 78. Depending on the amount of rigidity required for the particular application, the width 80 of the horizontal portion 70 is increased or decreased as needed.

Figure 5:
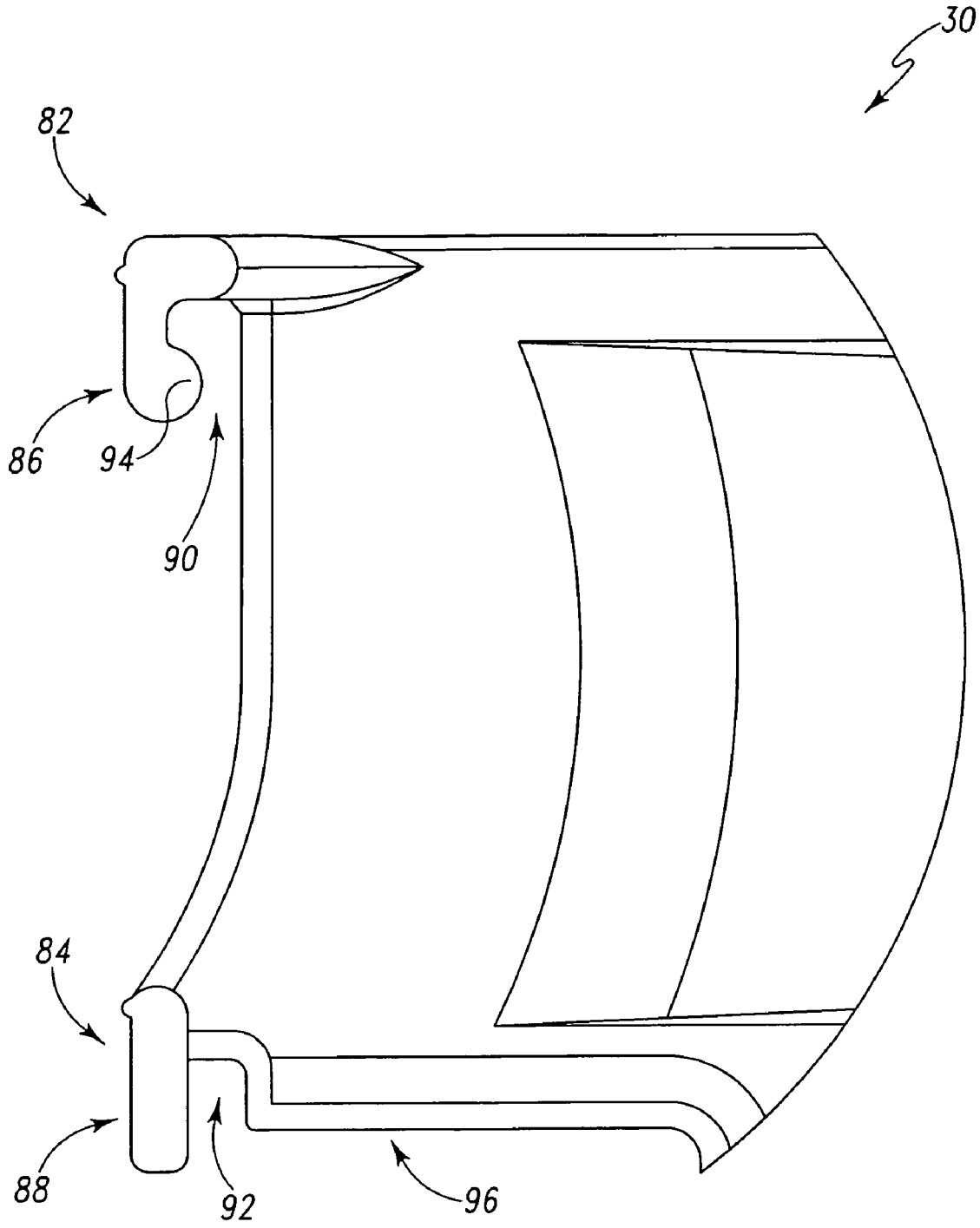
FIG. 5 is an elevation view of a front portion of the wall of FIG. 4.

The front end 76 of the divider wall 30 includes an upper hook retainer 82 vertically disposed above a lower hook retainer 84. The hook retainers 82 and 84 are spaced vertically the same general distance as the retaining rails 48, 50 of the front wall structure 28 such that they are adapted to engage and releasably lock with the elongated mounting clip 50, 52 of the front wall structure 28. In the illustrated embodiment, the hook retainers 82, 84 are integrally formed with the vertical wall and horizontal base portions 64, 70, respectively. As shown, the hook retainers 82, 84 are generally as wide as the width 30 of the horizontal portion 70. Even so, the hook retainers 82, 84 are wider or narrower in one embodiment. In FIG. 5, each of the hook retainers 82, 84 includes an elongated finger 86, 88 that forms a downwardly-directed channel 90, 92. The elongated finger 86 on the upper retaining rail 82 includes a pressure rib 94 projecting back toward the rear end 78 of the wall 30.

The front end 76 of each divider wall 30 also includes a relief 96 upwardly offset from the remainder of the horizontal portion 70. The relief 96 generally progresses from the front end 76 toward the rear end 78. The size and dimension of the relief 96 generally corresponds to the depth of the horizontal portion 40 forming a portion of the front wall structure 28.

Referring back to FIG. 4, in the illustrated embodiment the walls 30 each include a series of curved, spaced-apart ribs 98 and slots 100 that generally extend from top 102 to a bottom 104 of the vertical portion 64. The ribs and slots 102, 104 help define break-off sections 106 used to truncate the length 108 of the wall 30 to correspond to the depth 10 of the shelf 16 (see FIG. 1). The break-off sections are discussed in detail in U.S. Pat. No. 5,971,173 to Valiulis, et al., which is incorporated herein in its entirety by this reference.

Referring back to FIG. 1, each of the pair of walls 30 is engaged with the front wall structure 28 by respectively interlocking the upper and lower hook retainers 82, 84 of the divider walls 30 with the upper and lower retaining rails 46, 48 of the front wall structure 28. In particular, the channels 54, 56 formed by the mounting clips 46, 48 receive the elongated fingers 86, 88 and the channels 90, 92 formed by the elongated fingers 86, 88 receive distal ends of the mounting clips 50, 52 when the divider walls 30 and the front wall structure 28 are coupled together. In this regard, the divider walls 30 and the front wall structure 28 are snapped or slid together.

When the divider walls 30 and the front wall structure 28 are secured together, the walls are in opposing spaced relation to each other as shown in FIG. 1. Therefore, as will be more fully explained below, the walls 30 are able to guide the retail merchandise 12. In addition, the walls 30 are transverse to, and extend rearwardly from, the front wall structure 28 to define a product channel receptacle 112 (see FIG. 1) for the retail merchandise 12.

Despite being interlocked to the front wall structure 28, the divider walls 30 are laterally movable either toward or away from each other to increase or decrease the size of the receptacle 112. As such, retail merchandise 12 of a variety of different sizes and shapes is permitted within and accommodated by the receptacle 112. To ensure that unwanted movement of one of the divider walls 30 relative to the other wall does not occur after the walls have been suitably positioned, the pressure rib 94 on the finger 86 of the upper retaining rail 82 firmly engages with the channel 54 defined by the mounting clip 50. In other words, the divider walls 30 are held more securely in place after having been adjusted. The fit is snug enough to prevent the divider walls from moving out of place during use, but also allows a worker to manually readjust the relatively spacing of divider walls without special tools.

While separate divider walls are shown, it is possible in an embodiment for one of the divider walls 30 to be integrally formed with the front wall structure 28. As such, an "L-shaped" structure would be formed. In such an embodiment, a separate divider wall 30 that has not been integrally formed with the front wall structure 28 (but could be formed with another front wall structure) is interlocked with the L-shaped structure to form the receptacle 112. The non-integrally formed wall 30 is still able to slide toward and away from the integrally formed wall and re-size the receptacle 112.

As depicted in FIG. 1, in the illustrated embodiment the walls 30 are spaced-apart just enough to allow insertion of the retail merchandise 12 into the receptacle 112. Because of the close fit, the retail merchandise 12 engages the inner face 68 of the walls 30. Even so, the retail merchandise 12 is not prevented from movement toward and away from the front wall structure 28. The walls 30 are generally for preventing undesired lateral movement of the retail merchandise 12.

Figure 6:
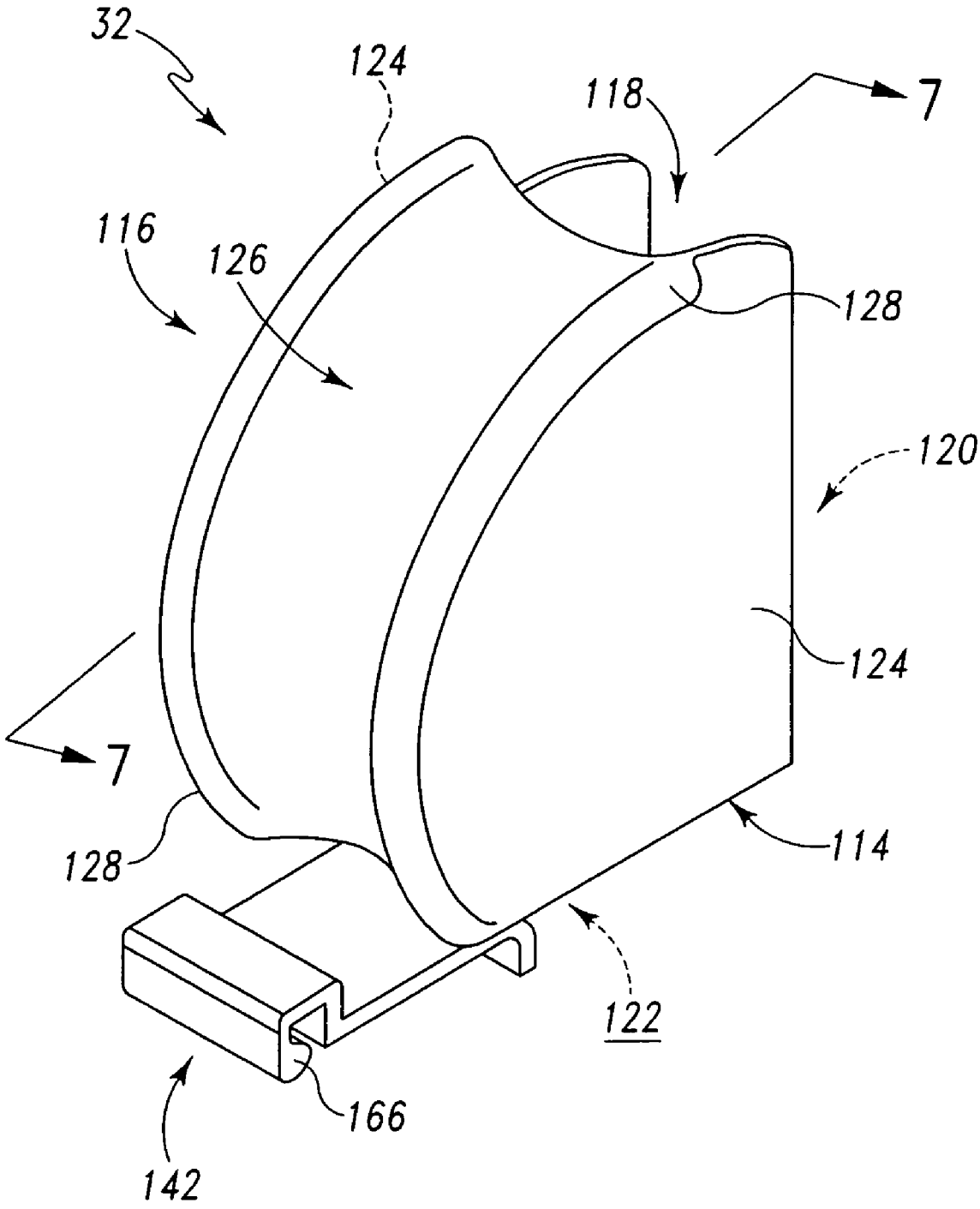
FIG. 6 is a top and front perspective view of a pusher from the pusher system of FIG. 1.

As shown in FIG. 6, the pusher 32 or paddle includes a pusher housing 114 having a curved forward face 116, an open top 118, an open back 120, and a generally planar bottom face 122. Therefore, when viewed from one of the sides 124, the pusher 32 possesses a radial profile due, in large part, to the curved front face 116. Overall, the pusher 32 has the general appearance of a quarter to a half circle. The forward face 116 of the pusher 32 includes a concave upright or vertical channel 126 defining a pair of spaced-apart, curved edges 128. Each of the channel and edges 126, 128 extends from near the bottom face 122 to the open top 118. Although generally co-planar with the sides 124, in one embodiment the channel 126 is widened and the edges 128 are outwardly offset from the sides 124.

Figure 7:
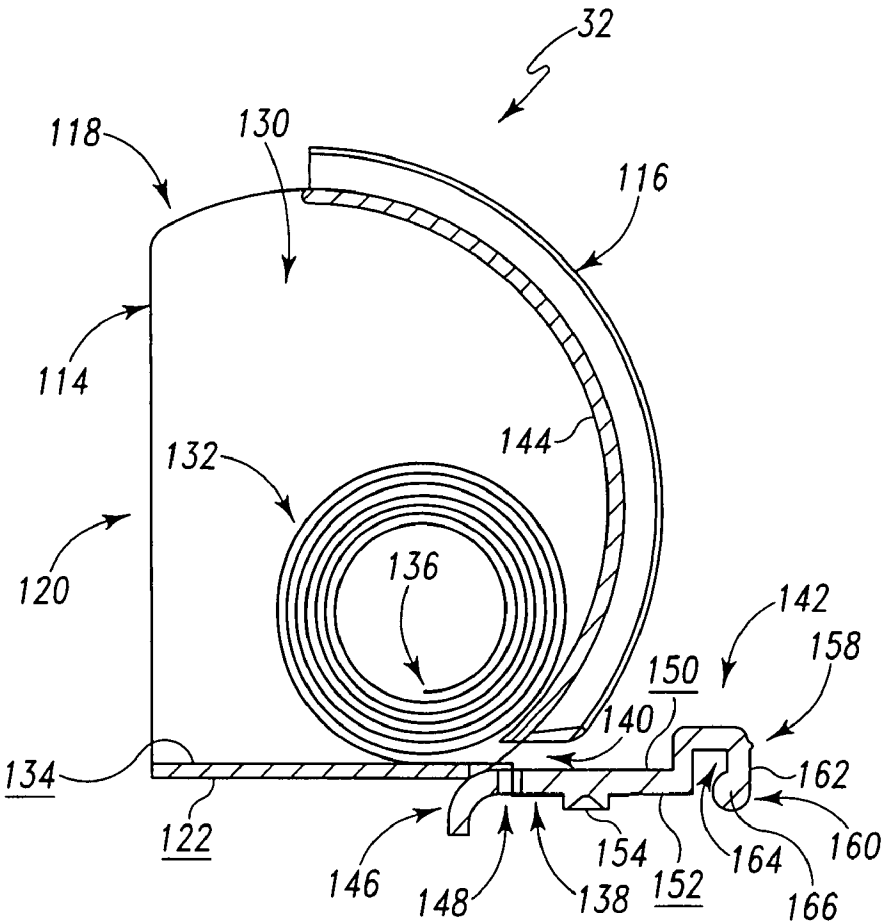
FIG. 7 is a cross section view of the pusher of FIG. 6.

Moving to FIG. 7, the open top and back 118, 120 permit viewing or inspection of a spring chamber 130 disposed within and defined by the pusher housing 114. The spring chamber 130 is sized and dimensioned to hold a spring member such as a spiral spring 132 (also known as or referred to as a clock spring). The spiral spring 132 is either a variable or constant force spring. In the illustrated embodiment, the spiral spring 132 is a thin, flat strip of metal that has been wrapped around itself.

In one embodiment, a bottom surface 134 of the spring chamber 130 includes an indicia, label, and/or marking indicating a strength of the spiral spring 132. For example, one of the letters "H", "M", or "L" is placed on the bottom surface 134 to indicate that the spiral spring 132 has a high, medium, or low spring force, respectively. In one embodiment, the strength indicator is suitably located elsewhere on the pusher housing 114 such as, for example, on a one of the sides 124.

In the illustrated embodiment, a first end 136 of the spiral spring 132 remains unattached to the pusher housing 114 while a second end 138 projects out of the pusher housing 114 through a bottom aperture 140 or slot. As shown, the second end 138 is generally secured to a mounting clip 142. In this arrangement, the mounting clip 142 and the spring force of the spiral spring 132 cooperate to maintain the spiral spring within the spring chamber 130 and keep the spiral spring biased against the inner wall 144 of the pusher housing 114.

The bottom aperture 140, which frees the second end 138 of the spiral spring 132 from the spring chamber 130, is formed at an intersection of the curved forward face 116 and the bottom face 122. Once clear of the pusher housing 114, the second end 138 travels over a rear portion 146 of the mounting clip 142. The rear portion 146 curves downwardly away from the pusher housing 114. The second end 138 next passes through an aperture 148 formed in the mounting clip 142. As illustrated, the aperture 148 extends between upper and lower surfaces 150, 152 and provides a passageway for the spiral spring 132 through the mounting clip 142. After the second end 138 passes through the aperture 148, the second end bends upwardly to engage a portion of the lower surface 152. As shown, the second end 138 also encounters a post 154 depending downwardly from the lower surface of the mounting clip 142.

Figure 8:
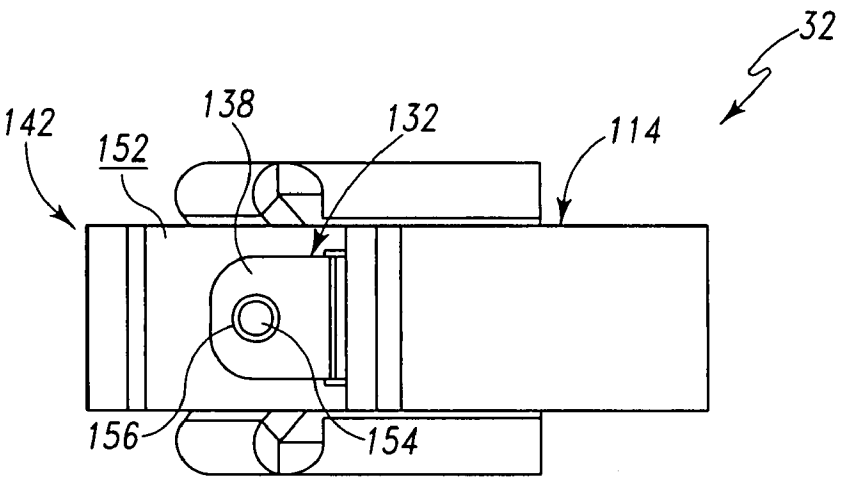
FIG. 8 is a bottom view of the pusher of FIG. 6.

As shown in FIG. 8, in the illustrated embodiment the post 154 passes through and mates with an aperture 156 formed in the second end 138 of the spiral spring 132. In one embodiment, the post 154 and the second end 138 of the spiral spring 132 are coupled together with by heat staking, a sonic weld process, or another known coupling method.

Referring back to FIG. 7, a front portion 158 of the mounting clip 142 includes a mounting hook 160 somewhat offset above the upper surface 150. In the illustrated embodiment, the mounting hook 150 includes an elongated finger 162 that forms a downwardly-directed elongated channel 164. The elongated finger 162 includes a pressure rib 166 projecting back toward the post 154. The mounting hook 150 is sized and dimensioned to releasably engage or interlock with the lower retaining rail 48 on the front wall structure 28 (see FIG. 2).

After the pusher 32 has been operably coupled to the front wall structure 28 via the mating retaining rails 48, 160, the pusher 32 is pulled away from the front wall structure. This action causes more of the spiral spring 132 to be drawn out of the pusher housing 114 through the bottom aperture 140. The further back the pusher 32 is moved, the more an unwound portion of the spiral spring 132 is extracted.

Referring back to FIG. 1, the pusher 32 is illustrated when incorporated into the pusher system 10. In the illustration, the pusher 32 has been pulled back away from the front wall structure 28. The pusher 32 is interposed between the pair of walls 30 and generally disposed behind the retail merchandise 12. As such, the retail merchandise 12 is supported on all sides, except its top, within the receptacle 112 of the pusher system 10.

Figure 9:
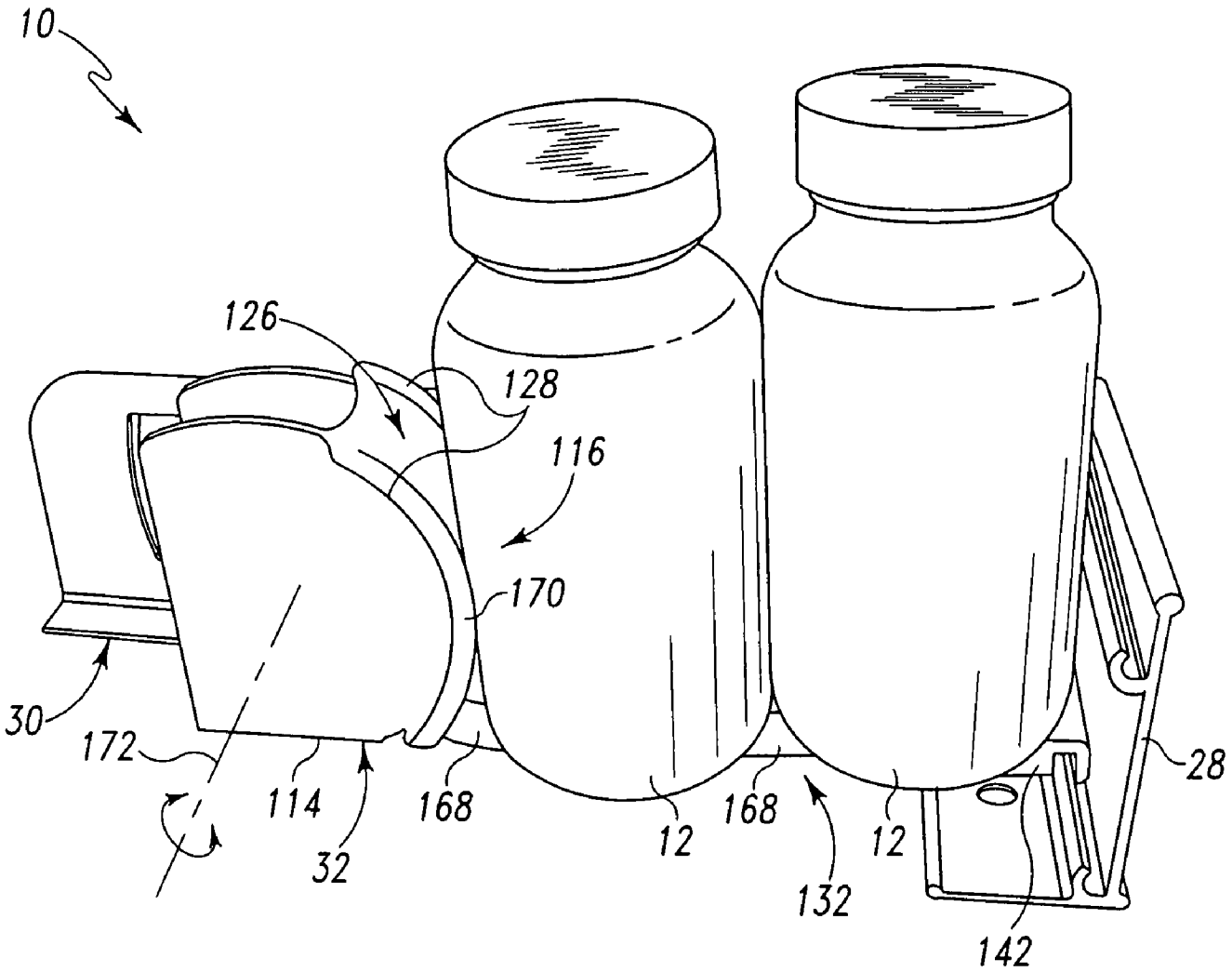
FIG. 9 is a side perspective view of the pusher system of FIG. 1 with a closest one of the walls from FIG. 4 removed.

To more clearly illustrate the pusher 32 within the pusher system 10, in FIG. 9 one of the walls 30 has been removed for the purpose of illustration. As a result, the pusher 32 and, in particular, the spiral spring 132 are visible. The spiral spring 132 is shown in a partially unwound state to accommodate the retail merchandise 12. The retail merchandise 12 generally engages with, and rides upon, the unwound portion 168 of the spiral spring 132 outside of the pusher housing 114. The unwound portion 168 of the spiral spring 132 is sized and dimensioned to support the retail merchandise 12. The retail merchandise 12 also engages with, and rests upon, the mounting clip 142. In FIG. 9, the mounting clip 142 is partially hidden under the item of retail merchandise 142 most proximate the front wall structure 28.

Because the pusher 32 is biased forward toward the front wall structure 28 by the spiral spring 132, the edges 128 of the curved forward face 116 engage the last item in the row of retail merchandise 12 at a single contact point 170. In addition, a portion of the last item extends or recesses into the vertical channel 126. Therefore, the retail merchandise 12 is centered between the pair of walls 30 as well as maintained in an upright orientation as illustrated in FIG. 1.

As FIG. 9 shows, if the pusher 32 is somewhat rotated in either direction about an axis of rotation 172, the single contact point 170 established between each of the curved edges 128 is maintained due to the radial profile of the pusher 32. Therefore, the retail merchandise 12 is easily re-inserted back into the pusher system 10 if inadvertently removed by, for example, a retail customer.

In the illustrated embodiment, the front wall structure 28, the walls 30, the pusher housing 114, and the mounting clip 142 are molded from a plastic such as being formed from a clear polymer resin, a polycarbonate, or another like material. As a result, these components or portions thereof have resilient properties and characteristics. Also, the spiral spring 132 is formed from stainless steel or other material capable of generating a spring force when rolled or otherwise curved.

In operation, a pair of walls 30 are coupled to the front wall structure 28 by mating the upper and lower hook retainers 82, 84 with the upper and lower retaining rails 46, 48. Thereafter, one of the walls 30 is laterally slid toward or away from the other wall to appropriately size the receptacle 112 to correspond to the size and dimensions of the retail merchandise 12. With the walls 30 in place, the mounting clip 142 of the pusher 32 is snapped onto the lower retaining rail 48 of the front wall structure 28. Next, the pusher 32 is pulled rearwardly away from the front wall structure 28. When this occurs, the spiral spring 132 is unwound and further extracted from the pusher housing 114.

With the pusher 32 in a retreated position away from the front wall structure 28, one or more items of the retail merchandise 12 are fitted between the front wall structure, the pusher, and the pair of walls 30 as shown in FIG. 1. In this arrangement, the retail merchandise 12 is seated upon the unwound portion 168 of the spiral spring 132 and, in some instances, engages with the walls 30. The force of the spiral spring 132 causes the pusher 32 to bias the entire linear row of retail merchandise 12 toward the front wall structure 28.

As shown in FIG. 1, the item of retail merchandise 12 most proximate the front wall structure 28 is biased against the front wall structure. In addition, the item or retail merchandise closest to the pusher 32 is engaged with the forward face 116 such that the curved edges 128 make single point contact 170 with that item and the item is recessed into the vertical channel 126. This action automatically centers the retail merchandise 12 within the receptacle 112.

When the foremost item of retail merchandise 12 is extracted from the pusher system 10, the spiral spring 132 biases the pusher 32 and the remaining items forward toward the front face. The remaining items of retail merchandise 12 slide over and upon the unwound portion 168 of the spiral spring 132 and/or the shelf 12. At the same time, some of the spiral spring 132 retreats into the spring chamber 130 and gets wrapped about the rest of the spiral spring. This process continues until all of the retail merchandise 12 has been removed from the pusher system 10.

To refill the pusher system 10, the retail merchandise 12 is forced between the front wall structure 28 and the pusher 32. When this occurs, the pusher 32 is biased away from the front wall structure 28 to make room for the retail merchandise 12 in the receptacle 112 and the spiral spring 132 is unwound. As more items are added, the receptacle 112 is enlarged by moving the pusher 32 back away from the front wall structure 28 and further unrolling the spiral spring 132.

If the last item of retail merchandise 12 has been extracted from the receptacle 112 and the pusher happens to, for example, rotate slightly clockwise or counterclockwise (see FIG. 9), the item is nonetheless easily reinserted due to curved forward face 116. Even when rotated, the curved edges 128 of the forward face 116 engage the retail merchandise 12 at the same height and width (i.e., at the single contact point 170) compared to when the pusher is not rotated.

In one embodiment, and for wider retail merchandise product, several of the pushers 32 are employed within the pusher system 10. In such a circumstance, the pushers 32 are spaced apart from each other, individually coupled to the front wall structure 28, and interposed between the pair of walls 30 as noted above. By using multiple pushers 32, retail merchandise 12 that is larger, heavier, and/or oddly contoured is also able to be automatically faced.

Additionally, it should be noted that the pusher 32 is free of a central track. Instead, the pusher 32 can hook directly on the front stop (e.g. the front wall structure 28) for the product channel. The pusher 32 is free to move laterally (i.e. a direction traverse to forward and back) between the divider walls 30. The divider walls 30 may be spaced at a span substantial equal to the width of the pusher 32 such that the pusher engages with and will be guided by the divider walls 30 (it may engage either or both of the upright and/or base portions 64, 70 of the divider walls 30). In such a circumstance, the retail merchandise product channel may only be as wide as the lateral span/width of the pusher 32. Alternatively, the divider walls 30 may be spaced wider such that the pusher 32 may not directly contact the upright portion 64 of the divider walls 32. In this situation, the pusher 32 will tend to self center on product merchandise due to the recess and two lateral points of contact (particularly for cylinders, elliptical bottles or other curved merchandise), and the product will engage the divider walls 30. As a result, the divider walls 30 indirectly guide and/or indirectly engage (e.g. through the merchandise) the pusher 32. It is also contemplated that the pusher 32 may also engage the inner side of the base portion 70 of the divider wall to assist in guiding movement of the pusher 32 during use.

The pusher system 10, including the front wall structure 28, pair of walls 30, pusher 32, and mounting clip 142 are, in one embodiment, packaged and offered for retail sale together. In the alternative, one or more of the components are sold separately.

From the foregoing, those skilled in the art will recognize that the pusher system 10 automatically faces the retail merchandise 12. The pusher system 10 is more compact than conventional gravity feed systems and, therefore, requires less space on the shelf 12. The pusher system 10 also operates without tracks found in many standard pusher systems. By not using tracks, the pusher system 10 is less likely to clog up, jam, and/or malfunction. In addition, since the horizontal portion 70 or base on the pair of walls 30 is of sufficient size, the pusher system 10 is rigid enough to support the retail merchandise 12 within the receptacle 112 without using a rear stop or rear wall. The rigidity of the pusher system 10, even without the rear wall, prevents the walls 30 from bowing or bending outwardly away from the retail merchandise. By eliminating the rear wall used by conventional pusher systems, material is saved and the overall cost of the pusher system 10 is reduced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track;

wherein a rear surface of the front wall structure includes an elongated clip extending rearward from the rear surface in a cantilevered arrangement and the pair of walls each include elongated fingers, the elongated clip and the elongated fingers mating to interlock the front wall structure and the pair of walls without preventing lateral movement of the walls; and wherein the elongated fingers and a horizontal base portion on the walls maintain a generally ninety degree angle between the walls and the front wall structure.

2. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track;

wherein a rear surface of the front wall structure includes an elongated clip extending rearward from the rear surface in a cantilevered arrangement and the pair of walls each include elongated fingers, the elongated clip and the elongated fingers mating to interlock the front wall structure and the pair of walls without preventing lateral movement of the walls; and wherein each of the elongated fingers includes a pressure rib, the pressure ribs inhibiting lateral movement of the pair of walls relative to each other.

3. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track;

wherein a rear surface of the front wall structure includes first and second clips in parallel spaced apart relation to each other, the first clip disposed vertically above the second clip, the first and second clips being arcuate forming vertically upward-directed channels, a distal end portion of each of the first and second clips extending forwardly toward the rear surface of the front wall structure forming first and second undercuts within the upward directed channels; and wherein the mounting clip connects to the second clip and each of the pair of walls includes a pair of vertically spaced apart vertically downward-directed first and second fingers, the first finger extending vertically downward into the channel of the first clip and the second finger extending vertically downward into the channel of the second clip.

4. A pusher system for biasing retail merchandise forward, the pusher system comprising:

a front wall structure;

a pair of walls operably coupled to and moveably interlocked with the front wall structure, the walls in adjustable and opposing spaced relation to each other and transverse to and extending rearwardly from the front wall structure to define a receptacle for the retail merchandise;

a pusher including a pusher housing interposed between the pair of walls and disposed rearward of the front wall structure, the pusher housing defining a spring chamber and having a forward face; and a mounting clip;

a spring coiled up and mounted in the spring chamber, the spring acting upon the pusher housing such that the pusher is movable toward the front wall structure between the pair of walls under the action of the spring, the pusher being movable laterally between and guided by the walls, the pusher being free of a central track, the spring secured to the mounting clip, the spring having an end portion extendable out of the pusher housing beyond the forward face; and an alignment structure formed into the front face of the pusher housing, the alignment structure having at least one channel configured for partially receiving the retail merchandise and for aligning the pusher housing relative to the retail merchandise; and the mounting clip interlocked with the front wall structure such that the pusher is coupled to the front wall structure at least in part through the spring, the spring unwinding and biasing the pusher toward the front wall structure when the pusher is drawn rearwardly away from the front wall structure such that the retail merchandise is faced.

5. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track;

wherein a forward end of the mounting clip includes a pressure rib and the front wall structure includes an elongated clip forming a linear channel, the pressure rib interlocking with the linear channel to couple the mounting clip and the front wall structure; and wherein the pressure rib extends rearwardly forming a first undercut and the elongated clip extends forwardly forming a cooperating second undercut, the pressure rib interlocking with the linear channel with the first and second undercuts engaging one another with the pressure rib extending into the second undercut to couple the mounting clip and the front wall structure.

6. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track;

wherein a rear surface of the front wall structure includes an elongated clip extending rearward from the rear surface in a cantilevered arrangement and the pair of walls each include elongated fingers, the elongated clip and the elongated fingers mating to interlock the front wall structure and the pair of walls without preventing lateral movement of the walls;

wherein each of the elongated fingers includes a pressure rib, the pressure ribs inhibiting lateral movement of the pair of walls relative to each other; and wherein the pressure rib extends rearwardly forming a first undercut and the elongated clip is substantially C-shaped such that a distal free end of the elongated clip extends forwardly toward the rear surface of the front wall structure forming a cooperating second undercut, the first and second undercuts engaging one another with the pressure rib extending into the second undercut to couple pair of walls and the front wall structure.

7. A pusher system for biasing retail merchandise forward, the pusher system comprising:

a front wall structure;

a pair of walls operably coupled to the front wall structure, the walls in opposing spaced relation to each other and transverse to and extending rearwardly from the front wall structure to define a receptacle for the retail merchandise;

a pusher interposed between the pair of walls;

a spring acting upon the pusher such that the pusher is movable toward the front wall structure between the pair of walls under the action of the spring, the pusher being movable laterally between and guided by the walls, the pusher being free of a central track; and wherein the pusher system has a loaded state and an unloaded state, wherein the pusher system carries retail merchandise therein in the loaded state, the pusher being free of a central track such that a bottom surface of the pusher does not contact any other structure of the pusher system in the loaded state, and wherein the pusher is configured to directly contact and slidably engage a retail support structure.

8. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation with each other;

a pusher interposed between the pair of walls and disposed rearward of the front wall structure, the pusher including a pusher housing, a mounting clip, and a spiral spring, the spiral spring biased against the pusher housing and secured to the mounting clip, the mounting clip interlocked with the front wall structure, the spiral spring unwinding and biasing the pusher toward the front wall structure when the pusher is drawn rearwardly away from the front wall structure such that the retail merchandise is faced, the pusher being free of a central track; and wherein the pusher system has a loaded state and an unloaded state, wherein the pusher system carries retail merchandise therein in the loaded state, the pusher being free of a central track such that a bottom surface of the pusher does not contact any other structure of the pusher system in the loaded state, and wherein the pusher is configured to directly contact and slidably engage a retail support structure.

9. A pusher system for facing retail merchandise, the pusher system comprising:

a front wall structure;

a pair of walls moveably interlocked with the front wall structure, the walls transverse to and extending rearwardly from the front wall structure and in adjustable opposing spaced relation to each other;

a plurality of pushers interposed between the pair of walls and disposed rearward of the front wail structure, the pushers coupled to the front wall structure at least in part through a spring, the spring drawing the pusher toward the front wall structure when the pusher is drawn rearwardly away from the front wall structure to face the retail merchandise, each one of the plurality of pushers being free of a central track; and wherein the pusher system has a loaded state and an unloaded state, wherein the pusher system carries retail merchandise therein in the loaded state, the plurality of pushers being free of a central track such that a bottom surface of each of the plurality of pushers does not contact any other structure of the pusher system in the loaded state, and wherein the pusher is configured to directly contact and slidably engage a retail support structure.

10. A pusher system for pushing retail merchandise, comprising:

a front wall structure;

a pair of walls in spaced relation to each other and extending rearwardly from the front wall structure to define a receptacle for the retail merchandise;

a pusher housing interposed between the pair of walls, the pusher housing defining a spring chamber and having a forward face, the pusher being free of a central track;

a spiral spring coiled up and mounted in the spring chamber, the spiral spring having an end portion extendable out of the pusher housing beyond the forward face;

an alignment structure formed into the front face of the pusher housing, the alignment structure having at least one channel configured for partially receiving the retail merchandise and for aligning the pusher housing relative to the retail merchandise; and wherein the pusher system has a loaded state and an unloaded state, wherein the pusher system carries retail merchandise therein in the loaded state, the pusher being free of a central track such that a bottom surface of the pusher does not contact any other structure of the pusher system in the loaded state, and wherein the pusher is configured to directly contact and slidably engage a retail support structure.

* * * * *